United States Patent [19]

Rodgers, Jr.

[11] 4,429,874

[45] Feb. 7, 1984

[54] GAME RACQUET FRAME

[75] Inventor: Robert E. Rodgers, Jr., Houston, Tex.

[73] Assignee: Leach Industries, Inc., San Diego, Calif.

[21] Appl. No.: 298,261

[22] Filed: Aug. 31, 1981

Related U.S. Application Data

[62] Division of Ser. No. 77,274, Sep. 20, 1979, Pat. No. 4,331,331.

[51] Int. Cl.[3] ..... A63B 49/10; A63B 49/12

[52] U.S. Cl. ..... 273/73 C; 273/DIG. 7; 273/DIG. 6

[58] Field of Search ..... 273/73 C, 73 D, 73 F, 273/73 G, 73 H, 73 J, 73 K

[56] References Cited

U.S. PATENT DOCUMENTS

| | | | |
|---|---|---|---|
| 3,582,073 | 6/1971 | Melnick et al. | 273/73 H |
| 3,814,423 | 6/1974 | Shockley et al. | 273/73 K X |
| 4,066,260 | 1/1978 | Rodgers | 273/73 C |

*Primary Examiner*—Richard C. Pinkham
*Assistant Examiner*—Matthew Schneider
*Attorney, Agent, or Firm*—LeBlanc, Nolan, Shur & Nies

[57] ABSTRACT

A composite racquetball racquet comprises a molded synthetic plastic frame member on which is adhesively bonded a generally U-shaped channel and a synthetic plastic bumper strip is adhesively bonded over the channel outer periphery at the outer head portion of the frame. Mechanical interlock formations are provided between the plastic frame member and the metal channel side walls.

1 Claim, 11 Drawing Figures

GAME RACQUET FRAME

This is a division of application Ser. No. 77,274, filed Sept. 20, 1979, now U.S. Pat. No. 4,331,331.

This invention relates to improvements in game racquets, particularly composite racquetball racquets having laminated synthetic plastic and metal structure.

It has been proposed to make racquets embodying various combinations of extruded or molded plastic and metal elements, and representative are the U.S. Letters Patents to Rodgers Jr. U.S. Pat. No. 4,066,260; Vaughn et al U.S. Pat. No. 3,702,701; Latham et al U.S. Pat. No. 3,625,512 and Popplewell et al U.S. Pat. No. 4,119,313.

The present invention is concerned mainly with racquets of the type disclosed in the above-identified Rodgers, Jr. patent wherein a composite metal and plastic frame comprises a plastic core member surrounded and partly enclosed by an extruded metal channel and a flexible bumper strip is mounted on the outer periphery of the channel, the core, channel and bumper strip being adhesively bonded.

In its preferred embodiment the invention contemplates a racquet of this type wherein a unitary plastic frame member is prefabricated as by a suitable molding operation which defines the head, throat and handle outlines, and the frame is then employed as a form around which a flexible metal reenforcing channel is applied and adhesively bonded, and the resultant racquet comprises the major object of the invention.

In some embodiments a flexible plastic bumper strip may be adhesively bonded along the channel outer periphery, and this laminate bent around and adhesively bonded to the prefabricated plastic frame member, and this is a further object of the invention.

It is a further object of the invention to provide a game racquet having novel plastic-metal-plastic frame structure.

It is another object of the invention to provide a game racquet having in combination a novel association of a plastic frame member and a partly enclosing reenforcing metal channel member wherein the members are adhesively bonded and additionally mechanically secured together by interlocking formations. Pursuant to this object the plastic frame member and the side walls of the channel may have coacting recesses and ribs or other coacting locking formations around the inner periphery of the frame.

Further objects of the invention will appear as the description proceeds in connection with the appended claims and the annexed drawings.

PREFERRED EMBODIMENTS

Figure 1:
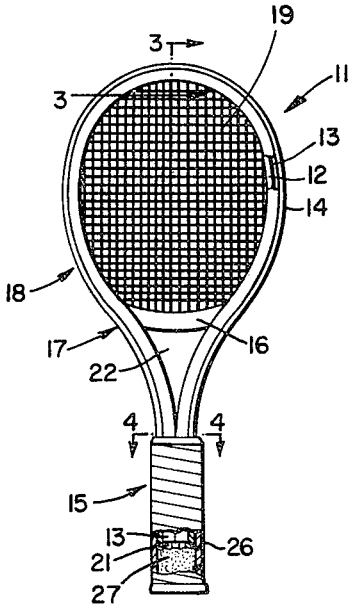
FIG. 1 is an elevational view showing the invention in a preferred embodiment.

FIG. 1 shows a racquetball racquet 11 consisting essentially of a prefabricated molded synthetic plastic frame member 12 on which is mounted an extruded metal reenforcing strip member 13 that includes a channel portion closely embracing the outer periphery and sides of the plastic frame member, an outer synthetic plastic strip 14 secured upon and along the outer periphery of the channel, and a handle 15. An integral yoke 16 extends across the throat 17 in a reversely curved part of the plastic frame member to form the inner periphery of the head 18 which contains the stringed striking area 19 of the racquet.

Figure 2:
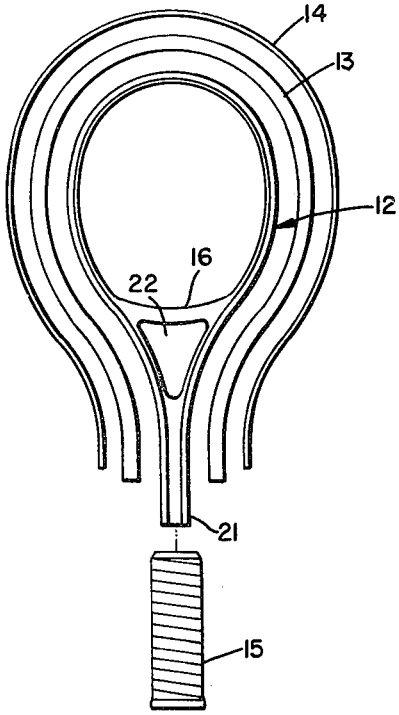
FIG. 2 is an exploded view showing the mode of construction of the FIG. 1 embodiment.
Figure 3:
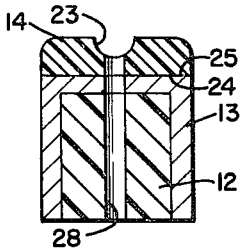
FIG. 3 is a section taken substantially on line 3—3 of FIG. 1 showing one form of laminated plastic-metal-plastic structure.
Figure 4:
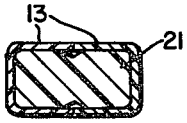
FIG. 4 is a section substantially on line 4—4 of FIG. 1, showing handle structure.

Referring to FIGS. 3 and 4 the plastic frame member 12 in this embodiment is of generally rectangular cross section in the sides of the head and throat portions, and solidly rectangular at 21 as it integrally merges into the handle. Frame member 12 is an integral molded member separately formed in a suitable mold (not shown) to the contour and shape shown in FIG. 2. Preferably the plastic frame member is formed of ABS, nylon, glass fibre reinforced resin, relatively rigid PVC or the equivalent, and its contours and dimensions are substantially those it displays in the complete racquet assembly.

The outer periphery and the flat sides of parallel side wall plastic frame member 12 are encased in U-shaped channel member 13 which is an extruded uniform cross section strip of aluminum or equivalent light metal or alloy.

In the invention the extruded metal reinforcement channel member 13 which is flexibly longitudinally bendable and of a size to snugly embrace the plastic frame member is slipped over the outer periphery of the prefabricated member 12 which serves as a form over which the strip 13 is bent. Before applying strip 13 the flat interior surfaces of the channel and/or the corresponding outer periphery and sides of frame member 12 are coated with a suitable metal-plastic bonding adhesive such as an epoxy type adhesive, whereby once the metal strip 13 is fitted tightly onto the plastic member 12 and held there until the adhesive sets the plastic frame member is substantially permanently rimmed with metal with the inner periphery of the head in the stringing area exposed. As shown the molded plastic frame member may have a space indicated at 22 for weight reduction, although this may contain a thin integral web if desired.

After the channel 13 is bonded upon the plastic frame member 12, the separately formed integral longitudinally flexible synthetic plastic bumper strip 14 is secured upon and around the outer peripheral area of channel 13. Strip 14 may be extruded and of the same material as frame member 12 and may be of uniform cross section with a central external recessed groove 23 extending its entire length. The flat inner side 24 of strip 14 which has substantially the width of the flat outer side 25 of metal channel member 13 is now bonded upon the outer periphery of the metal strip, a suitable adhesive such as an epoxy resin being provided between surfaces 24 and 25. The bumper strip may terminate at opposite ends adjacent the ends of yoke 16 since it is not required for head and stringing protection beyond those regions.

During the foregoing interfitting and bonding operation the molded plastic frame member is preferably held stationary in a jig (not shown), and strips 13 and 14 clamped in position while setting the respective adhesive bonds.

The solid handle end 21 of the prefabricated frame member 12 now may be mounted in the handle. Preferably this may be accomplished by providing a handle casing 26 closed at the bottom and open to receive the frame handle end 21. Between frame handle end 21 and the casing is a filling 27 of foamed polyurethane or like light plastic which when cured securely imbeds the handle end 21 and attaches the frame member to the handle. The handle may be wrapped as conventionally.

With the strips 13 and 14 permanently bonded in place the stringing holes 28 are drilled through the racquet head, and as shown in FIG. 3 these holes extend through plastic frame member 12, the bottom of channel 13 and bumper strip 14, opening outwardly into groove 23. The depth of groove 23 is sufficiently greater than the diameters of the strings that lie therein in passing between the stringing holes that the strings are protected against impact should the racquet head strike the floor or wall during play. The plastic opposite edges of holes 28 may be rounded to reduce string wear and facilitate threading.

A large number, if not all of the stringing holes may be formed at the same time by placing the assembly in a tool having a number of accurately spaced drills. This speeds up manufacture as well as ensuring uniform accurate hole spacing.

Figure 5:
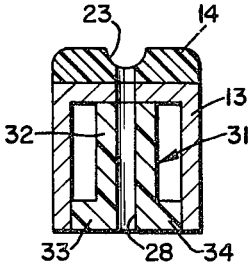
FIG. 5 is a section similar to that of FIG. 3 but showing an embodiment having a different plastic frame member in the combination.
Figure 6:
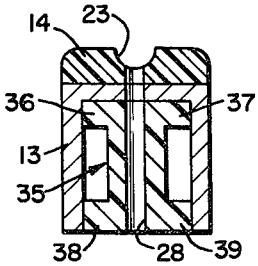
FIG. 6 is a section similar to that of FIG. 3 but showing an embodiment having a still further different plastic frame member in the combination.

In FIGS. 5 and 6 the assembly and mode of assembly are the same as in FIGS. 1–4, and these embodiments differ in the cross section and relative weight of the plastic frame member.

In FIG. 5 plastic frame member 31 is in the form of an inverted T in cross section with the leg 32 of the T terminating in a flat surface adhesively bonded to the flat inner surface of the closed bottom of the channel. The oppositely extended flanges 33 and 34 of the T similarly terminate in flat surfaces adhesively bonded to the inside surfaces of the channel as shown.

In FIG. 6 the molded plastic frame member 35 is of substantially H-shape in cross section in adhesive bonded attachment to the channel bottom and with opposite extending flanges 36, 37 and 38, 39 having flat surfaced adhesive bonding to the side walls of the channel.

The metal channel 13 and the bumper strip 14 are the same as in FIGS. 1–4 and similarly attached in the assembly.

Figure 7:
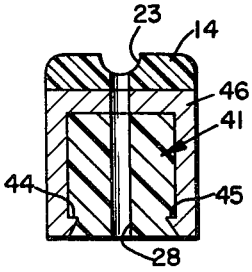
FIG. 7 is a section similar to that of FIG. 3 but showing interlocking formations on the plastic core member and the metal channel ends in the combination.
Figure 8:
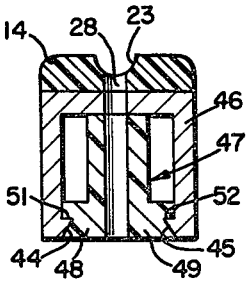
FIG. 8 is a section similar to that at FIG. 5 but showing interlocking formations on the plastic core member and the channel ends in the combination.
Figure 9:
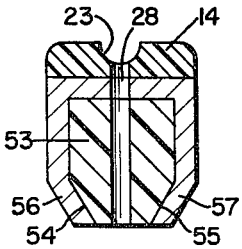
FIG. 9 is a section similar to that at FIG. 3 but showing a modified interlocking core and channel structure in the combination.

FIGS. 7, 8 and 9 illustrate embodiments wherein positive mechanical interlocking means is provided between the plastic frame member and the metal channel side walls.

In FIG. 7 the plastic frame member 41 is the same as in FIG. 3 except that on opposite sides it is formed with continuous parallel recesses 42 and 43 into which project continuous ribs 44 and 45 formed along the inner sides of the free ends of the side walls of channel 46 which otherwise is the same as channel 14.

In FIG. 8 the inverted T plastic frame member 47 is the same as in FIG. 5 except that the oppositely facing end surfaces of flanges 48 and 49 are formed with continuous recesses 51 and 52 into which project the continuous ribs 44 and 45 of the channel 46.

In the embodiments of FIGS. 7 and 8 the ribs could be formed on the plastic frame member and the recesses in the channel side walls, within the scope of the invention.

In FIG. 9 the plastic core member 53 is of solid cross section but around its inner periphery it is provided with a decreasing tapered section having oppositely inclined sides 54 and 55 against which bear the inturned oppositely inclined ends 56 and 57 of the channel side walls.

In the structures of FIGS. 7–9 the positive mechanical lock at the channel open end aids in holding the parts together while adhesive is setting and increases the delamination resistance of the plastic to metal bonded parts.

Figure 10:
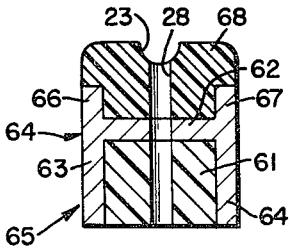
FIG. 10 is a section similar to that of FIG. 3 but showing a different form of extruded metal strip in the combination.

In FIG. 10 the plastic frame member 61 is solid and substantially fills the inwardly open channel defined by transverse wall 62 and the parallel side walls 63 and 64 of the extruded H-shaped metal strip 65. Here also the side walls extend as outer parallel walls 66 and 67 to define with transverse wall 62 a peripherally outwardly open recess wherein is seated the plastic bumper strip 68 of appropriate cross section. As shown bumper strip 68 projects inwardly to fill the outwardly open recess of the metal strip and protectively extends over the edges of the side walls.

Figure 11:
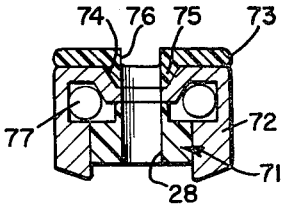
FIG. 11 is a further section like that of FIG. 3 but showing a different combination of the elements of the composite structure.

FIG. 11 illustrates a structure similar to that disclosed in U.S. Pat. No. 4,066,260 except that in this embodiment the inverted-T cross section plastic frame member 71 is a completely prefabricated molded member as in FIGS. 1–4, and the metal reenforcement channel member 72 and bumper strip 73 are applied to the molded frame member as above described. Here the cross portion of the T extends into adhesive bonded engagement with continuous ribs running along the open ends of the channel side arms and the bottom wall of the channel member 72 has a continuous outwardly open central recess or channel 74 that is filled by a projecting centrally depressed region 75 of the bumper strip that correspondingly forms a continuous outer recess 76 connecting the outer ends of the stringing holes 28.

In this embodiment, as in the embodiment of FIGS. 5, 6 and 8, there are internal closed spaces between the plastic frame member and the surrounding metal reenforcement member, and these spaces may contain suitable balancing weights 77 as shown in FIG. 11, or may be filled wholly or partly with a lightweight formed plastic for some desired weighting or structural purposes.

In all of the foregoing embodiments the plastic frame member is wholly contained within a channel that opens inwardly of the frame. The positive interlocking between the plastic frame member and the channel side arms, specifically shown in FIGS. 7–9, may be incorporated in all embodiments. In some embodiments the interlocking ribs and recesses may be located closer to the bottom wall of the channel than illustrated.

In all of the foregoing embodiments of the invention, straight lengths of the metal reinforcement strip and the plastic bumper strip may be adhesively bonded together, and then the resultant metal-plastic laminate bent and fitted over the periphery of the prefabricated plastic frame member to complete the plastic-metal-plastic structure before the stringing holes are formed and the handle attached. Also if desired strip 14 may be initially flat on both surfaces and groove 23 may be formed as by a machining operation in the straight plastic-metal laminate prior to forming it over the molded frame member.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A game racquet comprising a preformed unitary synthetic plastic frame member having integral defined head and throat portions and a solid integral handle end portion, said head including a yoke extending adjacent the throat to complete a closed perimeter for the stringing area, a metal channel member having, in cross-section, a generally U-shaped configuration defined by a planar bottom wall and a pair of planar side walls, said bottom wall having a flat inner surface extending across the entire width thereof and said side walls having flat inner surfaces extending the entire length thereof, said metal channel member snugly extending over the outer periphery and opposite sides of said plastic frame member, said plastic frame member being in the form of an inverted T with the stem of the T abutting the flat inner surface of the bottom wall of said channel member, and with the lateral flanges of the T extending into abutment with and adhesively secured to said side walls of said channel member, and a bumper strip adhesively bonded upon and along the outer periphery of said channel member at least at said head portion.

* * * * *